US007175253B2

(12) United States Patent
Lee et al.

(10) Patent No.: US 7,175,253 B2
(45) Date of Patent: Feb. 13, 2007

(54) MAINTENANCE APPARATUS USED WITH AN INKJET PRINTER

(75) Inventors: Yong-duk Lee, Gunpo (KR); Yong-gun Jung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 470 days.

(21) Appl. No.: 10/704,752

(22) Filed: Nov. 12, 2003

(65) Prior Publication Data

US 2006/0125874 A1 Jun. 15, 2006

(30) Foreign Application Priority Data

Jan. 17, 2003 (KR) ..... 10-2003-0003428

(51) Int. Cl.
*B41J 2/165* (2006.01)

(52) U.S. Cl. ..... 347/32; 347/23; 347/29; 347/30; 347/33

(58) Field of Classification Search ..... 347/22–35
See application file for complete search history.

(56) References Cited

U.S. PATENT DOCUMENTS 5,831,644 A * 11/1998 Kato ..... 347/22
5,971,520 A * 10/1999 Nakahara ..... 347/30
6,561,618 B1 * 5/2003 Simmons et al. ..... 347/32

* cited by examiner

*Primary Examiner*—Shih-Wen Hsieh
(74) *Attorney, Agent, or Firm*—Stanzione & Kim, LLP

(57) ABSTRACT

An inkjet printer driving a maintenance apparatus using a power to a feed roller. In the inkjet printer, the maintenance of the maintenance apparatus is started by a carriage. The maintenance apparatus includes a maintenance member which cleans and covers the nozzle of a print head, a maintenance cam which controls the maintenance member through a rotating motion, a maintenance gear which is disposed at one end of the maintenance cam and has a cut off portion in which a part of gear teeth is partially cut off in a face width direction, and a connection gear disposed on a shaft of the feed roller to be able to move in a shaft direction by the carriage and transmit the power of the feed roller. During the printing operation of the carriage, the connection gear is placed on the cut off portion, and then engaged with the teeth of the maintenance gear disposed adjacent to the cut off portion by the pushing of the carriage. The connection gear is supported in the shaft direction of the feed roller by a return spring, and the return spring returns the connection gear to place the connection gear on the cut off portion of the maintenance gear when the connection gear is not forced by the carriage.

30 Claims, 12 Drawing Sheets

MAINTENANCE APPARATUS USED WITH AN INKJET PRINTER

CROSS-REFERENCE TO RELATED APPLICATIONS

This application claims the benefit of Korean Application No. 2003-3428, filed Jan. 17, 2003, in the Korean Intellectual Property Office, the disclosure of which is incorporated herein by reference.

BACKGROUND OF THE INVENTION

1. Field of the Invention

The present invention relates to a maintenance apparatus used with an inkjet printer to maintain nozzles of a print head in good condition through a vertical motion, and more particularly to a maintenance apparatus used with an inkjet printer in which a maintenance operation is started by a carriage and powered from a feed roller shaft.

2. Description of the Related Art

A general inkjet printer is a printing apparatus printing an image by spraying ink stored in a print head through nozzles. Because the nozzle surface of the print head is often contaminated by sprayed ink during a printing process, it is necessary to regularly clean ink off the nozzle surface in order to obtain high quality printing. In addition, the nozzle may get blocked by dried ink when the nozzle is open to air without printing for a long period of time. Therefore, there have been various maintenance apparatuses developed to cover the nozzle to prevent such problems.

FIG. 1 shows a conventional maintenance apparatus for an inkjet printer.

Referring to FIG. 1, the maintenance apparatus for an inkjet printer comprises a wiper unit 10, a capping unit 20, a maintenance cam 30, and a motor 40.

The wiper unit 10 comprises a wiper 11 to clean nozzles, and a wiper elevation portion 13 to support an elevating movement of the wiper 11. The capping unit 20 comprises a cap 21 to cover the nozzles of a printer head, a resilient member 22 to resiliently support the cap 21, and a cap elevation portion 23 to guide an elevating movement of the resilient member 22. The maintenance cam 30 has a wiper cam 31 to lift the wiper elevation portion 13 and a capping cam 32 coaxially formed with the wiper cam 31 to lift the cam elevation portion 23, and a worm wheel 33 assembled at one side thereof. The motor 40 supplies power to elevate the wiper 11 and the cap 21, and press-fitted to a shaft of the motor 40 is a worm 41 which is engaged with the worm wheel 33.

Hereinafter, the operation of the conventional maintenance apparatus used with the inkjet printer structure as above is described.

When the motor 40 is rotated, the worm 41 assembled on the shaft of the motor 40 rotates, thereby rotating the worm wheel 33. When the worm wheel 33 rotates, the maintenance cam 30 rotates together with the wiper cam 31 and the capping cam 32. Accordingly, when cleaning the nozzles of the print head, the motor 40 is rotated a predetermined number of times to allow the wiper cam 31 to elevate the elevation portion 13. When the wiper 11 ascends, a carrier (not shown) moves the nozzles (not shown) of the print head left and right with respect to the wiper 11, thereby cleaning a nozzle surface of the nozzles. When printing is completed and the nozzles are covered, the print head is placed above the capping unit 20 and then the motor 40 is rotated a predetermined number of times to allow the capping cam 32 to lift the cap elevation portion 23. As the cap elevation portion 23 ascends, the cap 21 covers the print head, thereby preventing the nozzle from being exposed to air.

However, such a conventional maintenance apparatus used with an inkjet printer requires a separate motor to drive the maintenance apparatus, thereby increasing manufacturing costs. In addition, because more space is required for the separate motor, the size of the inkjet printer increases or the interior becomes less spacious. Furthermore, the use of the separate motor increases the weight of the inkjet printer, and since the cap is not fastened to the carriage, the cap and the nozzle may be dislocated when the printer receives a shock.

Therefore, there is a need for a maintenance apparatus used with an inkjet printer which can clean and cover the nozzles without a need for a separate motor and has the carriage and cap integrally fastened when the nozzles are capped.

SUMMARY OF THE INVENTION

In an effort to solve the above and/or other problems, it is an aspect of the present invention to provide a maintenance apparatus used with an inkjet printer which can perform a maintenance operation in which nozzles are cleaned and covered without a need of a separate motor.

Another aspect of the present invention is to provide a maintenance apparatus used with an inkjet printer which can prevent the capping location from being changed due to external shocks to the printer by fastening a cap and carriage together while the nozzle is capped.

Additional aspects and advantages of the invention will be set forth in part in the description which follows and, in part, will be obvious from the description, or may be learned by practice of the invention.

The foregoing and/or other aspects of the present invention are achieved by providing a maintenance apparatus used with an inkjet printer which conveys paper to a feed roller and prints by spraying ink through a nozzle of a print head loaded on a carriage. The maintenance apparatus to maintain the nozzle of the print head includes a maintenance member moving in a vertical direction to clean and cover the nozzle of the print head, a maintenance cam to control the maintenance member through a rotating motion, and a connection unit to selectively transmit the power of the feed roller to the maintenance cam through the carriage. In accordance with the movement of the connection unit by an influence of the carriage, the maintenance cam is rotated by the power from the feed roller so that the maintenance member cleans and covers the nozzle of the print head.

The connection unit includes a connection gear disposed on a shaft of the feed roller to be able to move in a shaft direction by the influence of the carriage and transmits the power of the feed roller, and a maintenance gear disposed at one end of the maintenance cam and engaged with the connection gear by the connection gear moving in the shaft direction.

The maintenance gear has a cut off portion formed thereon in which a part of gear teeth is partially cut off in a face width direction, and the connection gear is positioned on the cut off portion such that the power of the feed roller is not transmitted to the maintenance gear during a printing process.

The connection gear is supported in the shaft direction of the feed roller by a return spring, and the return spring returns the connection gear to place the connection gear on the partial gear of the maintenance gear with the cut off portion formed thereon when the connection gear is not forced by the carriage. The connection gear has a lever contacting the carriage. The lever has a lever shaft which supports the connection gear to move in the shaft direction of the feed roller.

The maintenance member includes a wiper unit to allow the carriage to clean the nozzle, a capping unit to cover the nozzle, and a frame to guide the wiper unit and the capping unit to be elevated by the maintenance cam.

The wiper unit includes a wiper to clean the nozzle, a wiper guiding portion to support the wiper and to be elevated with respect to the frame by the maintenance cam, and a first return spring to bias the wiper guiding portion downward.

The capping unit includes a cap to cover the nozzle, a cap elastic member to elastically bias the cap upward, a cap guiding portion with the cap elastic member disposed thereon, the cap guiding portion being elevated with respect to the frame by the maintenance cam, and a second return spring biasing the cap guiding portion downward. The cap guiding portion also has a fixing support inserted in the carriage when the cap covers the nozzle.

The maintenance cam includes a wiper cam to elevate the wiper unit, and a capping cam positioned at a predetermined angle with respect to the wiper cam when viewed from a shaft direction. The capping cam elevates the capping unit.

It is another aspect of the invention that the angle of the capping cam with respect to the wiper cam is 180°. The maintenance cam is fixed by a fixing member when the connection gear is not engaged with the maintenance gear. The fixing member includes a fixing cam groove formed on the maintenance cam, and a fixing portion disposed on the frame and inserted in the fixing cam groove to prevent the maintenance cam from rotating when the connection gear is not engaged with the maintenance gear.

The foregoing and/or other aspects of the present invention may also be achieved by providing an inkjet printer that conveys paper to a feed roller, prints by spraying ink through a nozzle of a print head loaded on a carriage, and performs maintenance of the nozzle of the print head. The inkjet printer includes a maintenance member moving in a vertical direction to clean and cover the nozzle of the print head, a maintenance cam to control the maintenance member through a rotating movement, a maintenance gear disposed at one end of the maintenance cam and having a cut off portion with a part of gear teeth partially cut off in a face width direction, and a connection gear disposed on a shaft of the feed roller to transmit a power of the feed roller and move in a shaft direction by the carriage at the same time. The connection gear is positioned on the cut off portion while the carriage prints, and is engaged with teeth of the maintenance gear disposed adjacent to the cut off portion when the carriage pushes the connection gear, thereby rotating the maintenance cam.

The connection gear is supported in the shaft direction of the feed roller by a return spring, and the return spring returns the connection gear to place the connection gear on the cutoff portion of the maintenance gear with the cut off portion formed thereon when the connection gear is not forced by the carriage.

As described above, with the maintenance apparatus used with an inkjet printer according to the present invention, without having to use a separate motor, nozzles of the print head can be maintained in a desired condition through maintenance operations such as nozzle cleaning and covering.

Further, because the cap and the carriage are fastened to each other during the capping, the cap can be maintained at a predetermined position with respect to the nozzles.

Therefore, an inkjet printer according to the present invention is capable of performing maintenance operations, such as cleaning and covering of the nozzles of the print head, without having to use a separate motor, and has the cap and carriage fastened to each other during the capping so as not to be dislocated by external shocks.

A maintenance apparatus to clean print head dispensing nozzles of an ink jet printer, the ink jet printer having a paper feed roller and a carriage containing the ink print head therein, the maintenance apparatus comprising a maintenance unit to move toward and away from the nozzles to clean and cover the nozzles, a maintenance cam to control the movement of the maintenance unit, and a connection unit to selectively transmit power from the feed roller to the maintenance cam by movement of the carriage.

In an aspect of this embodiment, the connection unit comprises a connection gear disposed on a shaft of the feed roller movable in a shaft direction of the feed roller by movement of the carriage and transmitting a power of the feed roller, and a maintenance gear disposed at one end of the maintenance cam and engaging with the connection gear when the connection gear is moved by the carriage.

In another aspect of this embodiment, the maintenance apparatus used with an inkjet printer according to claim 27, wherein the maintenance unit comprises a wiper unit to clean the nozzles, a capping unit to cover the nozzles, and a frame to guide the wiper unit and the capping unit to be moved by the maintenance cam.

The capping unit may include a cap to cover the nozzles, a cap elastic member to elastically bias the cap toward the nozzles, a cap guiding portion with the cap elastic member disposed thereon, the cap guiding portion being moved with respect to the frame by the maintenance cam, and a second return spring biasing the cap guiding portion away from the nozzles.

A maintenance apparatus used with a printer to clean at least one nozzle of a print head, the printer having a paper feed unit feeding a sheet to be printed by the print head in a printing operation, the maintenance apparatus comprising a maintenance unit movable to maintain the at least one muzzle of the printhead in a maintenance operation, and a connecting unit to selectively transmit a power of the paper feed unit to the maintenance unit to move with respect to the print head.

A method used with a maintenance apparatus of a printer having a paper feed unit, the method comprising selectively transmitting a power of the paper feed unit to a maintenance unit to move with respect to the print head to maintain at least one nozzle of the print head in a maintenance operation.

A method used with a maintenance apparatus of a printer having a paper feed unit, the method comprising causing a maintenance unit to be movable to maintain at least one nozzle of a printhead, causing a maintenance cam to control a movement of the maintenance unit, and selectively transmitting a power from the paper feed unit to the maintenance cam.

A method of cleaning at least one nozzle of a printhead of an inkjet printer using a maintenance apparatus, the method comprising detecting whether a signal to clean at least one nozzle of the printhead has been provided, moving a carriage of an inkjet printer to a maintenance position to clean the at least one nozzle of the printhead, thus causing a connection gear to slide away from an original position and along a feed roller shaft of a feed roller and to engage with a gear teeth portion of a maintenance gear of the maintenance apparatus, if the signal to clean the at least one nozzle of the printhead has been detected rotating the feed roller shaft, thus causing the maintenance gear to rotate by a first predetermined amount if the carriage is moved to the maintenance position, moving the carriage back to the home position, thus causing the connection gear to return to the original position while remaining in engagement with the maintenance gear, rotating the feed roller, thus rotating the maintenance gear by a second predetermined amount to move a wiper toward the at least one nozzle, and moving the carriage toward the wiper, thereby moving the at least one nozzle across the wiper, thus cleaning the wiper.

BRIEF DESCRIPTION OF THE DRAWINGS

These and/or other aspects and advantages of the present invention will become apparent and more readily appreciated from the following description of the embodiments, taken in conjunction with the accompanying drawings of which:

FIG. 7A shows the maintenance apparatus during a printing process;

FIG. 7B shows a connection gear engaged with a maintenance gear by a carriage;

FIG. 7C shows the carriage returning to a home position;

FIG. 7D shows a state of the carriage in nozzle cleaning; and

FIG. 7E show a nozzle when it is capped by a capping unit; and

DETAILED DESCRIPTION OF THE PREFERRED EMBODIMENTS

Figure 1:
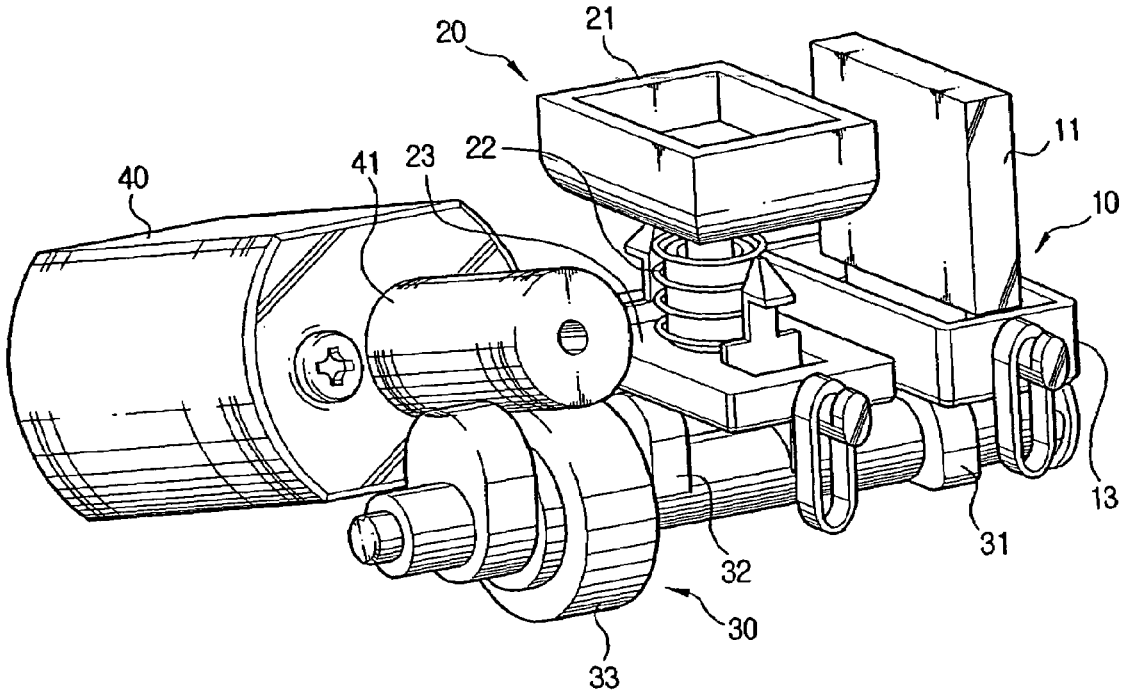
FIG. 1 (PRIOR ART)
FIG. 1 is a perspective view showing a conventional maintenance apparatus used with an inkjet printer.
Figure 2:
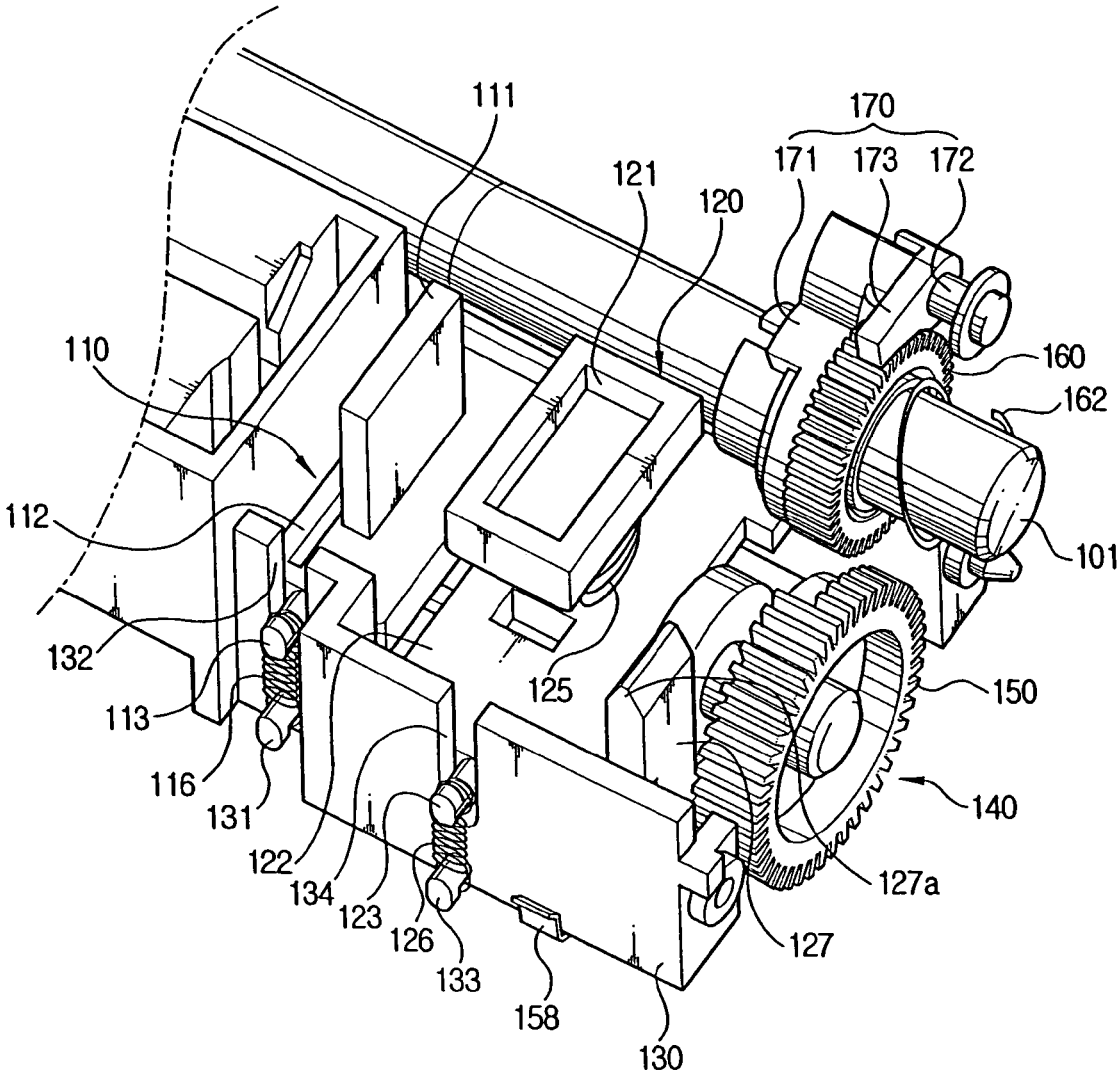
FIG. 2 is a perspective view showing a maintenance apparatus and a paper feed unit used with an inkjet printer according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIGS. 2 to 6, a maintenance apparatus used with an inkjet printer according to the present invention comprises a maintenance member 110, 120 and 130, a maintenance cam 140, and a connection unit 150 and 160.

The maintenance member 110, 120, 130 maintains one or more nozzles of a print head, which is loaded on a carriage 105. In the present embodiment, the maintenance member comprises a wiper unit 110, a capping unit 120, and a frame 130.

The wiper unit 110 wipes off the ink at the nozzles of the print head during printing as the carriage 105 reciprocates with respect to a wiper 111 of a predetermined width. The wiper unit 110 comprises the wiper 111, a wiper guiding portion 112, and a first return spring 116. The wiper 111 is made of a rubber material having a predetermined resiliency to clean ink off from the nozzle in contact therewith. The wiper guiding portion 112 is disposed inside the frame 130 and comprises a plurality of first guiding pins 113 to ascend and descend by a first guiding hole 132 formed on the frame 130. The wiper 111 is disposed on an upper surface of the wiper guiding portion 112 so that when the wiper guiding portion 112 is elevated, the wiper 111 is elevated together with the wiper guiding portion 112. The first return spring 116 is a tension spring and has one end fastened on one of the first guiding pins 113 of the wiper guiding portion 112, and the other end fastened on a first fastening pin 131 formed on the frame 130. Therefore, the wiper guiding portion 112 is always pulled downwards by the first return spring 116.

Figure 5:
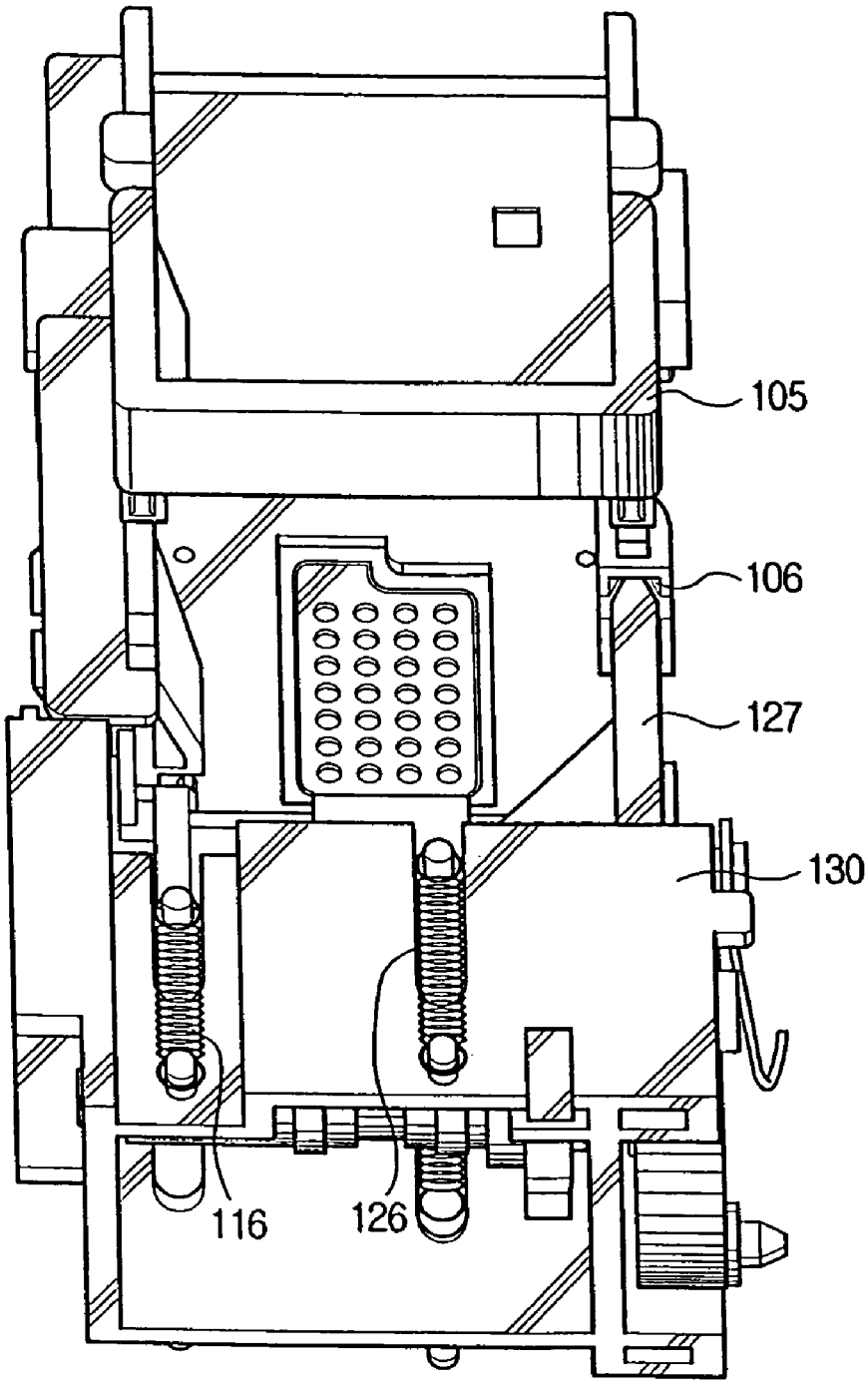
FIG. 5 is a perspective view showing a fastening pole of a cap guiding portion of a maintenance apparatus of FIG. 2 inserted in a carriage.

The capping unit 120 covers the nozzles of the print head, thereby preventing ink on the nozzle from becoming dry by external air. The capping unit 120 comprises a cap 121, a cap elastic member 125, a cap guiding portion 122, a second return spring 126, and a fixing support 127. The cap 121 keeps in direct contact with the nozzles to prevent ink inside the nozzles from drying by air. The cap elastic member 125 buffers when the nozzle comes into contact with the cap 121, and is disposed under the cap 121. Usually, a compressing spring is used as the cap elastic member 125. The cap guiding portion 122 is disposed inside the frame 130 and comprises a plurality of second guiding pins 123 to ascend and descend along the second guiding hole 134 formed in the frame 130. The cap elastic member 125 and the cap 121 are disposed on an upper surface of the cap guiding portion 122, and when the cap guiding portion 122 ascends and descends, the cap 121 ascends and descends together with it. The second return spring 126 is a tension spring and has one end fastened to one of the second guiding pins 123 of the cap guiding portion 122, and the other end fastened to a second fastening pin 133 formed on the frame 130. Therefore, the cap guiding portion 122 is always pulled downwards by the second return spring 126. The fixing support 127, which is another distinctive element of the present invention, fixes the cap guiding portion 122 and the carriage 105 together as shown in FIG. 5, thereby preventing the cap 121 from moving off the nozzles due to an external shock while the cap 121 is covering the nozzles. Such a fixing support 127 is formed to protrude upright at one side of the cap guiding portion 122 and is shaped to effectively fix the cap guiding portion 122 to the carriage 105. The front end 127*a* of the fixing support 127 is formed in a wedge shape, and the corresponding part of the carriage 105 has a groove 106 formed to correspond with the front end 127*a* of the fixing support 127.

Figure 4:
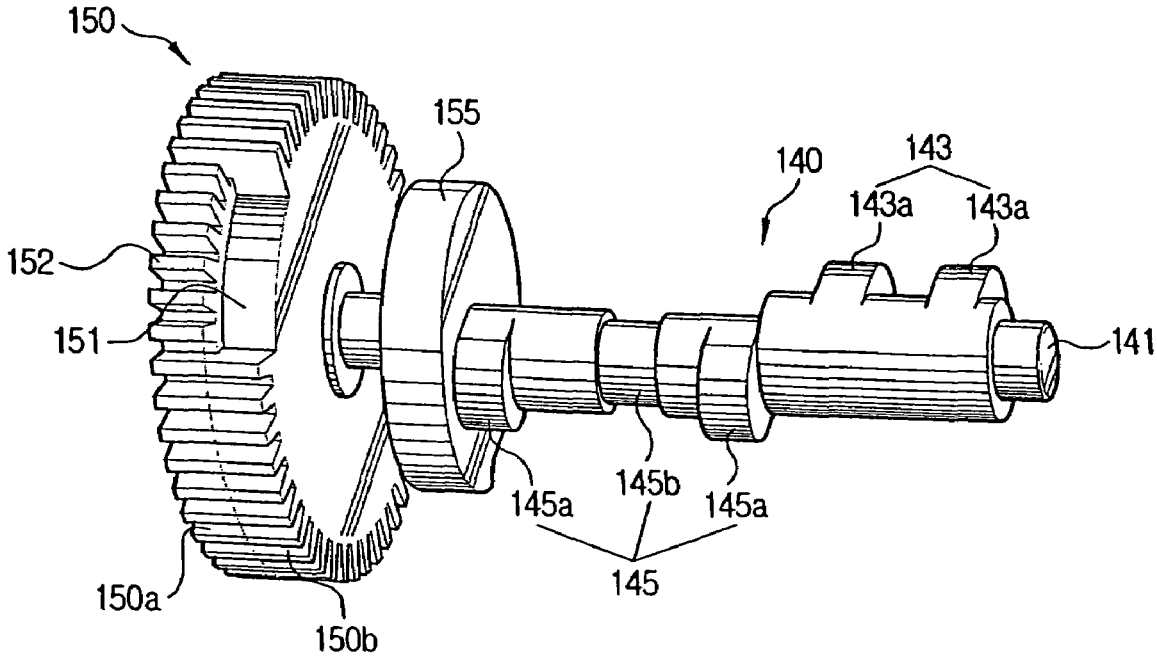
FIG. 4 is a perspective view showing a maintenance cam of the maintenance apparatus shown in FIG. 2.

The maintenance cam 140, rotating by a power transmitted from a feed roller shaft 101, controls the above described wiper unit 110 and capping unit 120, thereby cleaning and covering the nozzles. The maintenance cam 140 comprises a maintenance shaft 141 being a center of the rotation, a wiper cam 143 protruding from the maintenance shaft 141 to elevate the wiper unit 110, and a capping cam 145 protruding from the maintenance shaft 141 to elevate the capping unit 120. The maintenance shaft 141 is located below the wiper guiding portion 112 and the cap guiding portion 122, and is disposed to rotate by the power transmitted from the feed roller shaft 101 through a connection unit which will be described later. The wiper cam 143 is formed on the maintenance shaft 141 corresponding to the wiper guiding portion 112 to elevate the wiper guiding portion 112 once according to one rotation of the maintenance shaft 141. On the wiper cam 143 are formed two protrusions 143*a* which are spaced away from each other by a predetermined distance, as shown in FIG. 4, for a precise movement. The capping cam 145 is formed on the maintenance shaft 141 to correspond with the cap guiding portion 122 and elevates the cap guiding portion 122 once according to one rotation of the maintenance shaft 141. The capping cam 145 is formed to have two protrusions 145*a* which are spaced away from each other by a predetermined distance similar to the wiper cam 143 described above for a precise movement. A guiding groove 145*b* is provided between the two protrusions 145*a*. The guiding groove 145*b* guides a guiding rod 122*a*, which is disposed below the cam guiding portion 122. In addition, the capping cam 145 is formed such that it is at a predetermined angle with respect to the wiper cam 143 when viewed from a shaft direction of the maintenance shaft 141. The predetermined angle between the capping cam 145 and the wiper cam 143 may vary depending on the overall control of the inkjet printer, but in this embodiment the predetermined angle between the capping cam 145 and the wiper cam 143 is 180°.

The connection unit 150 and 160 comprises a connection gear 160 disposed on the feed roller shaft 101, and a maintenance gear 150 disposed on the maintenance shaft 141 to engage the connection gear 160 to transmit power of the feed roller shaft 101 to the maintenance cam 140.

Figure 3:
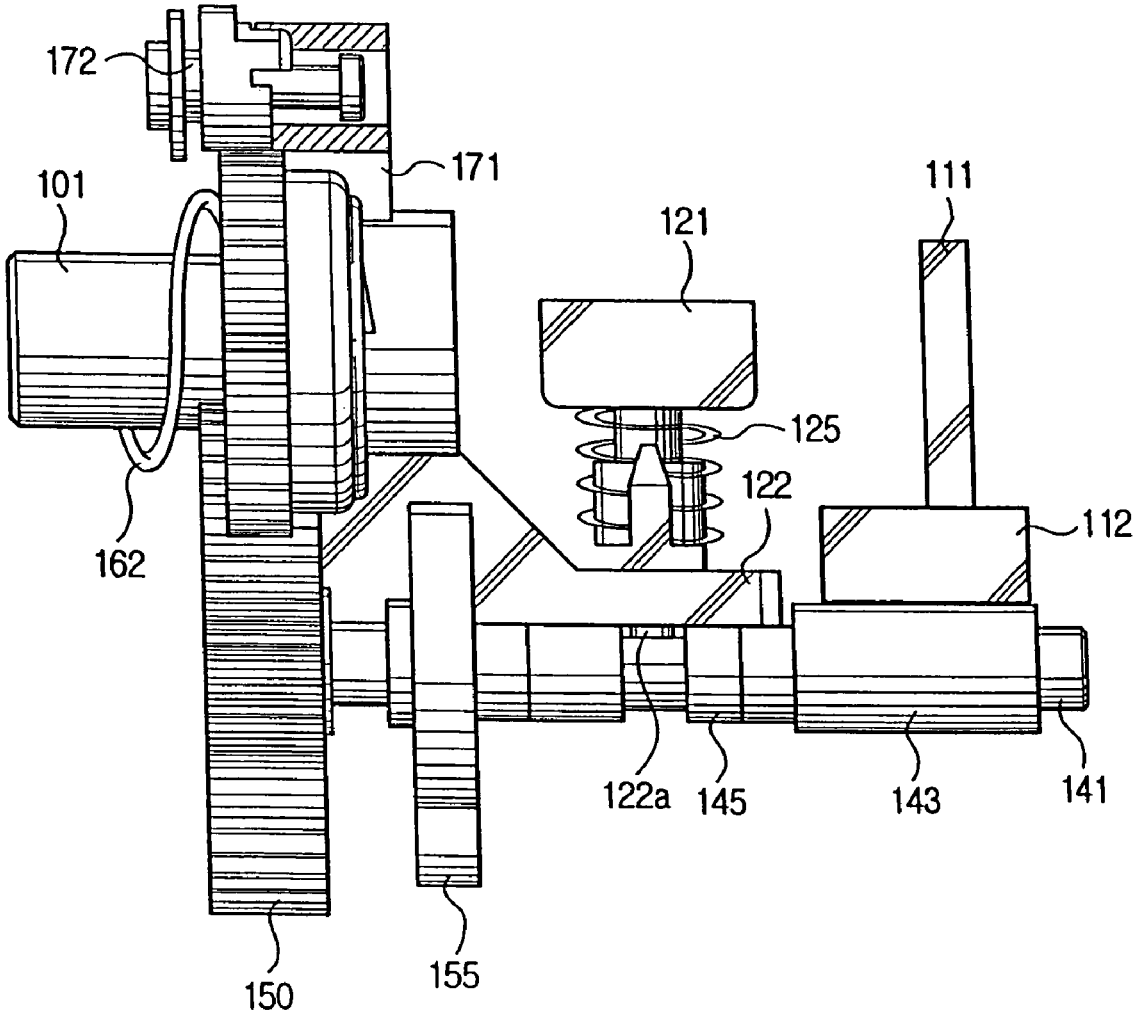
FIG. 3 is a front view showing the maintenance apparatus used with the inkjet printer shown in FIG. 2.

The connection gear 160 transfers rotation power of the feed roller shaft 101 to convey paper to a printing position, and moves in a shaft direction. That is, the connection gear 160 rotates together with the feed roller shaft 101, and at the same time, is able to move in a shaft direction along the feed roller shaft 101. This can be realized by disposing the connection gear 160 on the feed roller shaft 101 using a parallel key, or by forming a spline in the connection gear 160 and adopting a spline shaft as a feed roller shaft. In addition, the connection gear 160 is biased by a return spring 162. The return spring 162 moves the connection gear 160 back to its original location when the carriage 105 moves to its original location, thereby having no force applied to the connection gear 160 by the carriage 105 after the connection gear 160 moves in a predetermined direction by a predetermined distance along the feed roller shaft 101 by the carriage 105. The connection gear 160 may comprise a lever 170 in order to ensure smooth contact with the carriage 105. The lever 170 comprises a lever body 171 moving along the feed roller shaft 101 together with the connection gear 160 while rotatably supporting the connection gear 160, a lever shaft 172 guiding and limiting the left and right movement of the lever body 171, and a lever arm 173 protruding from the lever body 171 and in contact with the carriage 105. The lever shaft 172 is assembled to slide left and right in relation to the lever body 171 and restricts a movement range of the lever body 171, thereby restricting the movement range of the connection gear 160 on the feed roller shaft 101. FIG. 3 shows a partial sectional view showing the lever body 171 assembled on the lever shaft 172 in order to show the relationship between the lever shaft and the lever body 171.

The maintenance gear 150 is disposed at one side of the maintenance cam 140 to engage the connection gear 160. The maintenance gear 150 has a face width wider than those of the connection gear 160. The maintenance gear 150 is a type of a partial gear which partially has no gear teeth or has a cut off portion 151 with the teeth cut off as much as a predetermined width, as shown in FIG. 4. The cut off portion 151 is sized not to cause the connection gear 160 to interfere with the teeth around the cut off portion 151 of the maintenance gear 150 when the connection gear 160 is located on the cut off portion 151. In addition, when the connection gear 160 is located on the cut off portion 151 and then moved in a direction along the feed roller shaft 101 by the carriage, the gear teeth of the connection gear 160 enters between gear teeth 152 at one side of the cut off portion 151, thereby having the connection gear 160 and the maintenance gear 150 engaged. Therefore, the gear teeth 152 of the maintenance gear 151 at one side of the cut off portion 151 have a face width as wide as necessary to sufficiently transmit power of the connection gear 160 when the gear teeth 152 are engaged with the connection gear 160. In addition, the cut off portion 151 of the maintenance gear 150 is at a predetermined angle between itself and the wiper cam 143. The wiper cam 143 should be placed where it does not lift the wiper guiding portion 112 when the cut off portion 151 is placed below the connection gear 160, that is, when no power is transmitted to the maintenance gear 150. Accordingly, the predetermined angle between the cut off portion 151 and the wiper cam 143 is determined to satisfy such condition. In this embodiment, the protrusions 143*a* of the wiper cam 143 are disposed to be parallel to the bottom on which the frame 130 is disposed, and the cut off portion 151 is formed at an obtuse angle with the wiper cam 143 when the connection gear 160 is above the cut off portion 151. Therefore, when the maintenance gear 150 rotates by 90° in engagement with the connection gear 160, the protrusions 143*a* of the wiper cam 143 are at right angles to the bottom surface of which the frame 130 is disposed. Hereinafter, as shown in FIG. 4, with the maintenance gear. 150 being divided virtually in half in a face width direction, the part of the maintenance gear 150 with the cut off portion 151 will be called a partial gear portion 150*b*, and the part without the cut off portion 151 formed thereon will be called a whole gear portion 150*a*.

Figure 6:
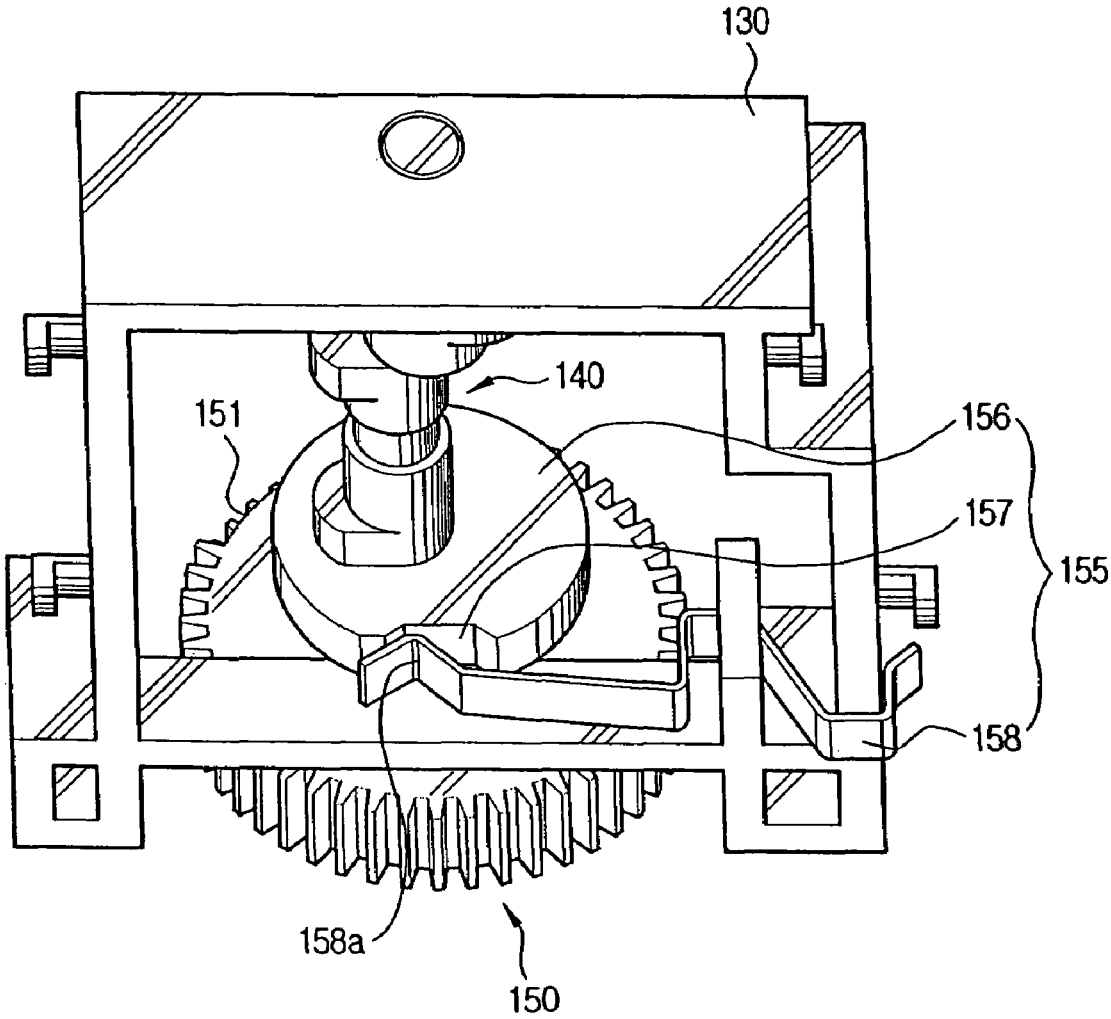
FIG. 6 is a perspective view showing a fastening member of the maintenance apparatus shown in FIG. 2.

In addition, the maintenance gear 150 has a fixing member 155 disposed thereon to prevent the maintenance gear 150 from rotating and thus engaging with the connection gear 160 due to an external shock when the connection gear 160 is placed above the cut off portion 151. The fixing member 155 comprises a fixing cam 156 formed on the maintenance shaft 141 on which the maintenance gear 150 is assembled, and a fixing portion 158 to prevent the maintenance gear 150 from rotating freely by pressing the fixing cam 156. The fixing cam 156 is a type of a cam which has a fixing cam groove formed thereon to receive the fixing portion 158 when the cut off portion 151 of the maintenance gear 150 is placed below the connection gear 160, as shown in FIG. 6. The fixing portion 158 is a type of a plate spring which is provided to prevent the maintenance gear 150 from freely rotating by the protrusion 158*a* formed on the front end pressing the fixing cam groove 157 with a predetermined pressure. At this time, the fixing portion 158 presses against the fixing cam groove 157 to prevent the maintenance gear 150 from rotating as the printer body is shaken or moved, but allows the maintenance gear 150 to rotate by the connection gear 160. The fixing portion 158 is disposed in the frame 130 as shown in FIG. 6.

Hereinafter, an operation of an embodiment of the maintenance apparatus used with an inkjet printer according to the present invention will be described in detail while referring to FIGS. 2 through 8.

Figure 7A:
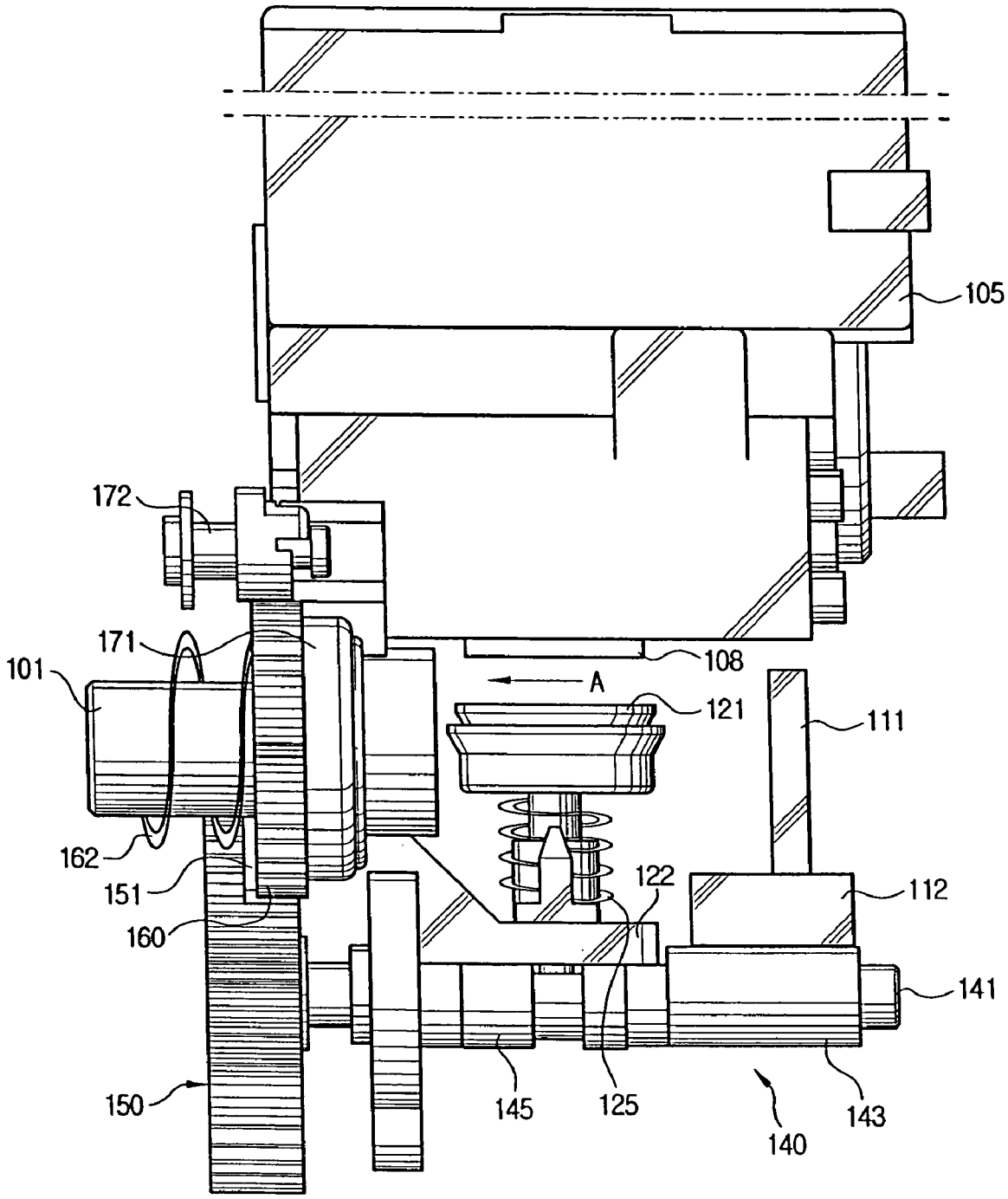
FIGS. 7A to 7E illustrate the operations of the maintenance apparatus of an inkjet printer shown in FIG. 2.

First of all, when the inkjet printer is printing, the connection gear 160 is placed in the cut off portion 151 of the maintenance gear 150, as shown in FIG. 7A.

Figure 7B:
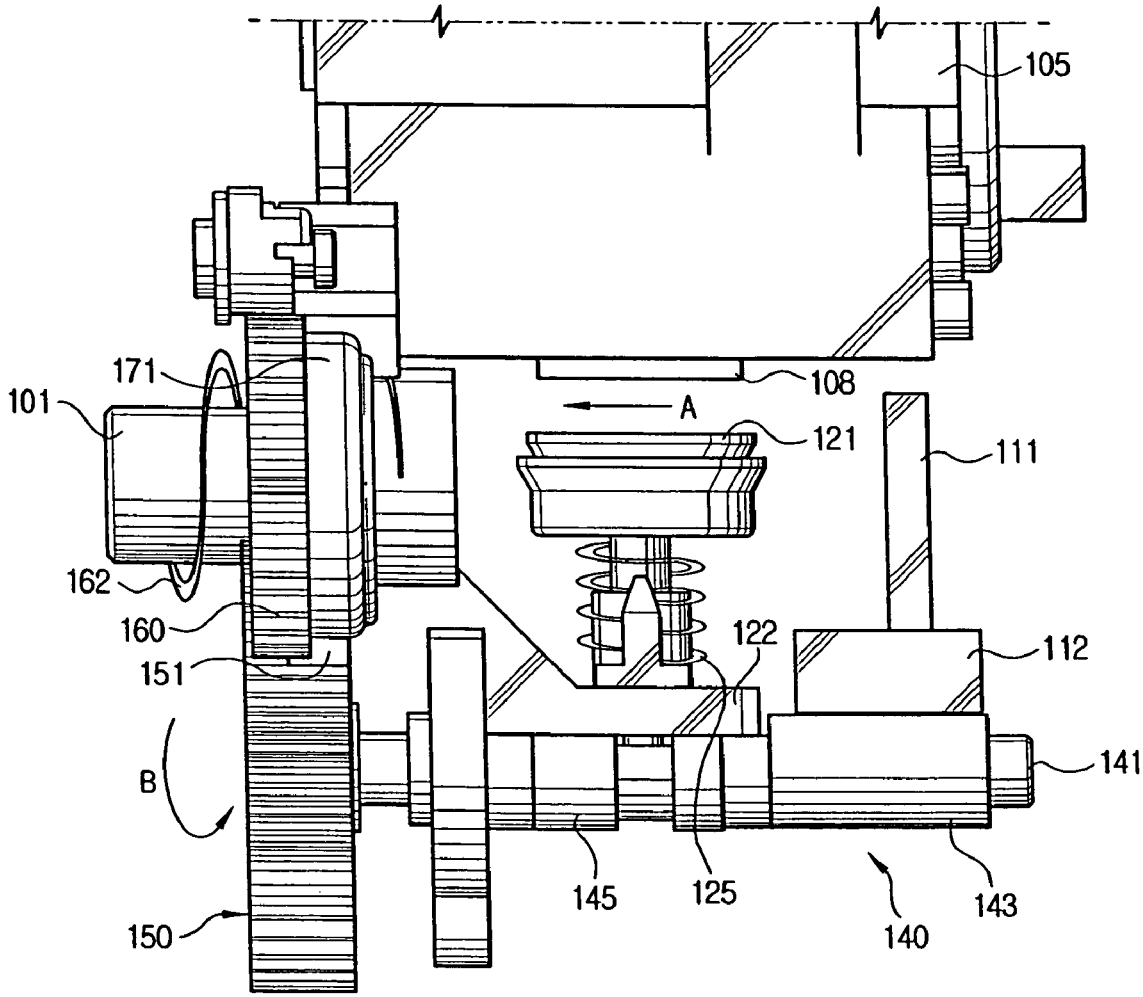

At this time, if the nozzle cleaning begins by the control unit (not shown) of the inkjet printer (S10), the carriage 105 moves left (arrow A of FIG. 7A) until it reaches the maintenance position, thereby pushing the lever arm 173 left (S11). When the lever arm 173 is pushed, the connection gear 160 slides left along the feed roller shaft 101, thereby engaging the gear teeth 152 at one side of the cut off portion 151 of the maintenance gear 150 (FIG. 7B). Here, the maintenance position is where the connection gear 160 is engaged with the maintenance gear 150, and is located on the left by a predetermined distance from the home position, where the carrier 105 is only in contact with the lever arm 173 and not applying any force to the lever arm 173. At this time, it is possible that the distance between the home position and the maintenance position is smaller than or equal to the face width of the connection gear 160.

Figure 7C:
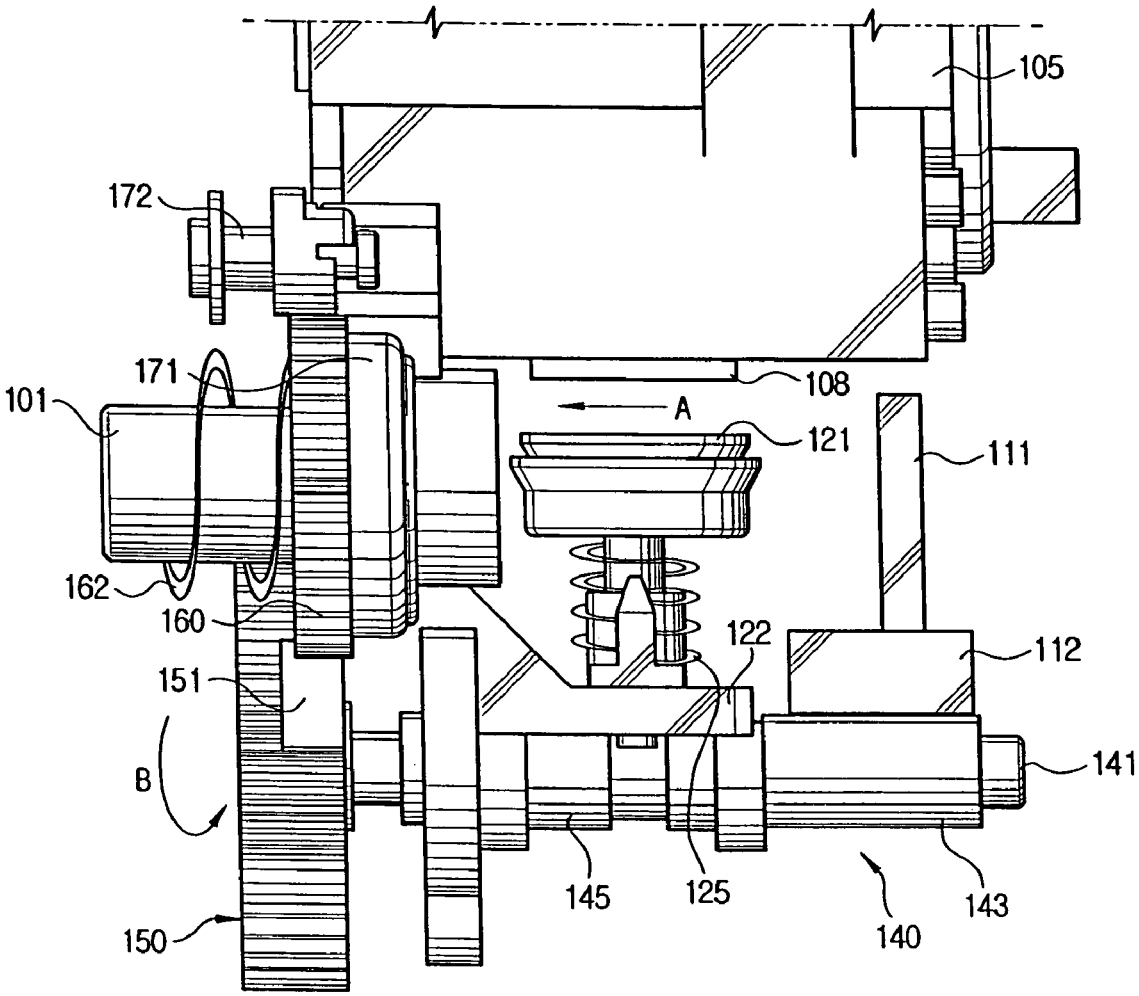
Figure 7D:
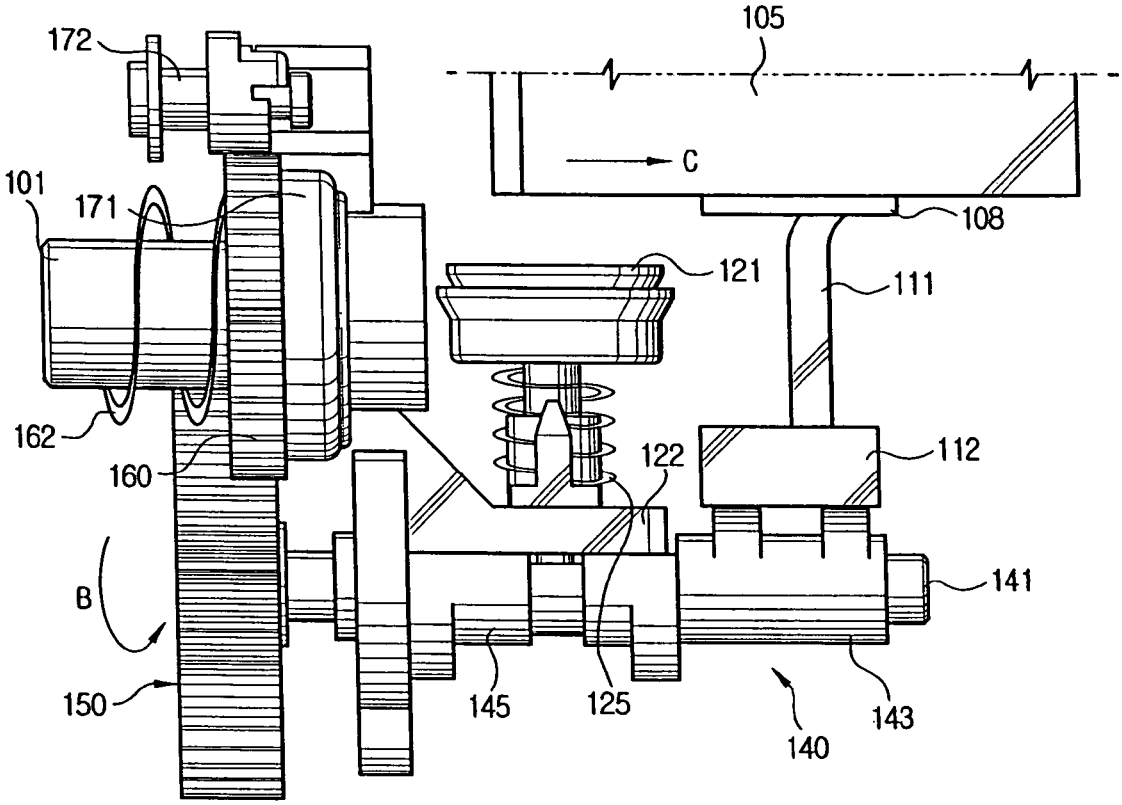

When the connection gear 160 is engaged with the maintenance gear 150, the control unit rotates the feed roller shaft 101 so that the maintenance gear 150 rotates by 30° in the direction shown in an arrow B of FIG. 7B (S12). After that, the control unit returns the carriage 105 back to the home position (S13). Then, the connection gear 160 moves to the right by the return spring 162, thereby returning to its original position (FIG. 7C). At this time, since the cut off portion 151 is no longer directly below the connection gear 160, the maintenance gear 150 is still in engagement with the connection gear 160 even when the connection gear 160 has returned to its original position. The control unit, at this time, rotates the feed roller shaft 101 again so that the maintenance gear 150 rotates by 60° in the arrow B direction (S14). Then, the wiper cam 143 rotates and causes the protrusions 143*a* to be at right angles with the bottom surface. When, the protrusions 143*a* of the wiper cam 143 are at right angles with the bottom surface, the wiper guiding portion 112 ascends to place the wiper 111 at a position to clean the nozzle 108 (FIG. 7D). At this time, the wiper guiding portion 112 is guided to be elevated by the plurality of first guiding pins 113 and first guiding holes 132. In this state, the control unit moves the carriage 105 to the wiper 111, thereby cleaning the nozzle 108 (S15). The control unit can have the nozzle 108 cleaned by allowing the carriage 105 to pass the wiper 111 only once or allowing the carriage 105 to reciprocate many times with respect to the wiper 111.

When printing again after cleaning the nozzle 108, the carriage 105 continuously moves to the right (arrow C direction in FIG. 70) and prints (S16, S22). When the carriage 105 continues to print, the feed roller rotates to feed paper, and therefore the connection gear 160 assembled on the feed roller shaft 101 rotates. Accordingly, the maintenance gear 150 also rotates. When the maintenance gear 150 rotates, the wiper cam 143 rotates together with it, and the wiper guiding portion 112 then descends to the lower end portion of the first guiding hole 132 by a force of the first return spring 116. However, when the feed roller shaft 101 continuously rotates and the maintenance gear 150 further rotates by 270° from the cleaning position, the connection gear 160 is positioned on the cut off portion 151 of the maintenance gear 150. Then, the maintenance gear 150 is disengaged from the connection gear 160 and does not rotate anymore. At this time, the protrusions 145*a* of the capping cam 145 and the protrusions 143*a* of the wiper cam 143 are positioned to be in parallel with the bottom surface of the wiper guiding portion 112. After a predetermined amount of printing occurs, the nozzle 108 begins cleaning as the control unit moves the carriage 101 to the maintenance position, as described above (S10, S11).

Figure 7E:
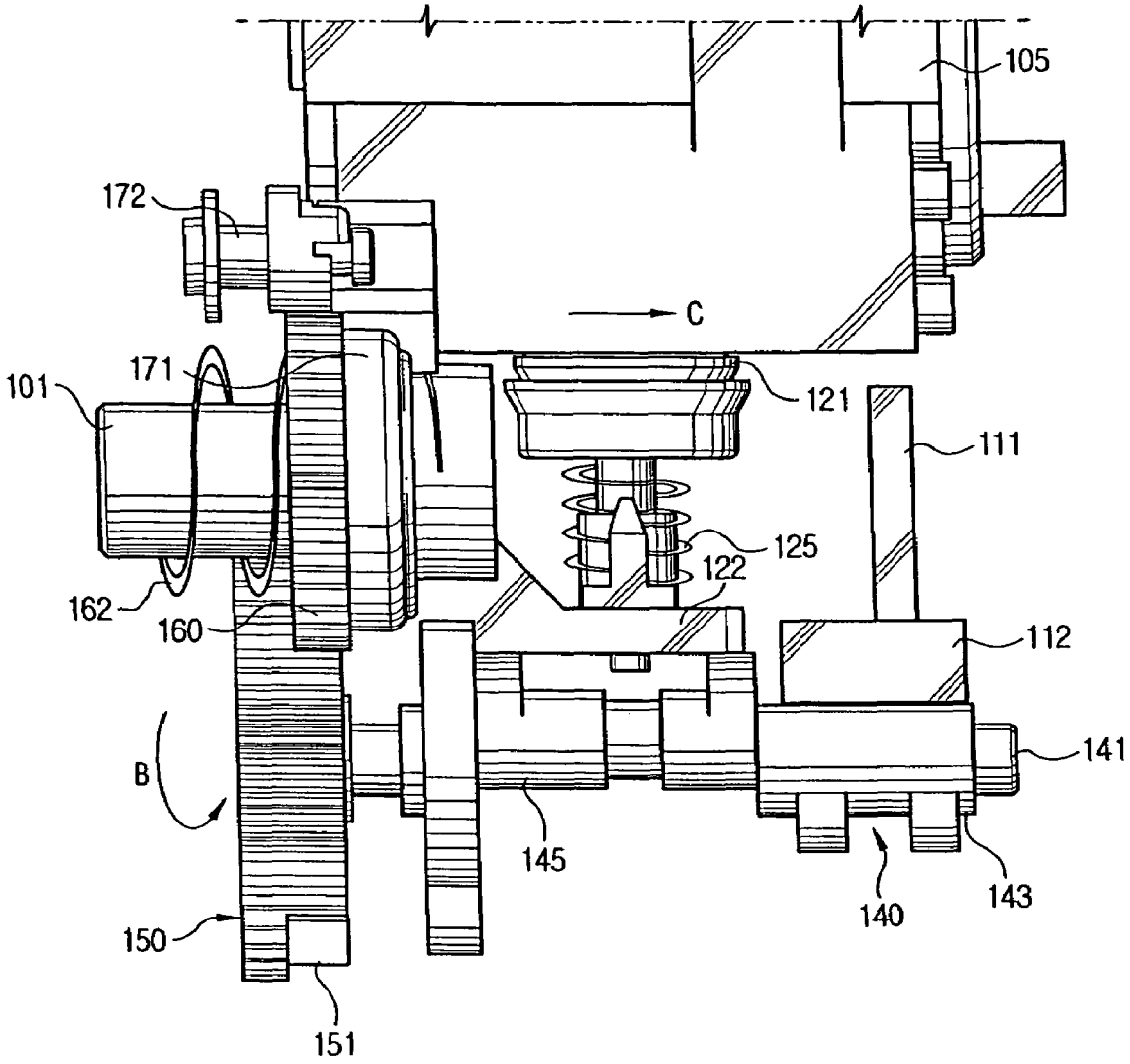
Figure 8:
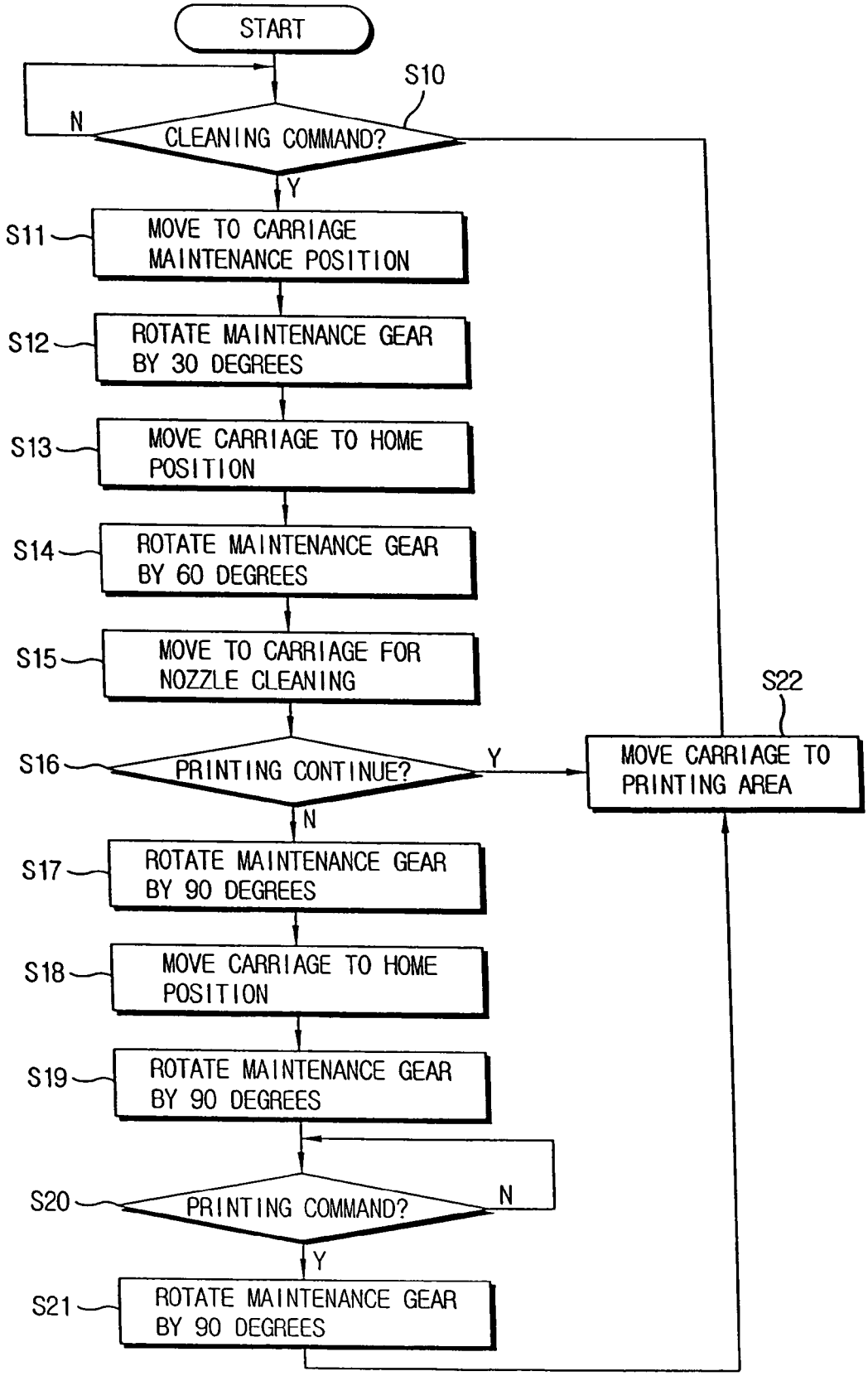
FIG. 8 is a flow chart showing an example of a method of controlling the maintenance apparatus by a control unit of an inkjet printer comprising the maintenance apparatus shown in FIG. 2.

However, after cleaning the nozzle 108, when capping the nozzle 108, the control unit rotates the feed roller shaft 101 in the state shown in FIG. 7D, thereby further rotating the maintenance gear 150 in the arrow B direction by 90°, and then moves the carriage 105 to the home position so that the carriage 105 can be in a state shown in FIG. 7A (S17, S18). At this state, the protrusion 143*a* of the wiper cam 145 and the protrusion 145*a* of the capping cam 145 is in parallel with the bottom surface and therefore do not interfere with the moving carriage 105. When the carriage 105 is moving toward to the home position, the control unit rotates the feed roller shaft 101, thereby further rotating the maintenance gear 105 in the arrow B direction by 90° (S19). When the maintenance gear 150 rotates by 90° in the arrow B direction, the protrusions 145*a* of the capping cam 145 are at right angles to the bottom surface of the cap guiding portion 122. When the protrusions 145*a* of the capping cam are at right angles to the bottom surface of the cap guiding portion 122, the cap guiding portion 122 ascends and the cap 121 covers the nozzle 108 of the print head, which is loaded in the carriage 105 (FIG. 7E). At this time, the cap 121 covers the nozzle 108 with a predetermined pressure as the cap elastic member 125 is interposed between the cap 121 and the cap guiding portion 122. The ascending movement of the cap guiding portion 122 is guided by the second guiding pin 123 provided in the cap guiding portion 122 and the second guiding hole 134 formed on the frame 130. As the cap guiding portion 122 ascends, the cap 121 covers the nozzle 108, and at the same time the fixing support 127, disposed on the cap guiding portion 122, is inserted in the fixing groove 106 provided in the carriage 105. When the fixing support 127 is inserted in the fixing groove 106, the nozzle 108 and the cap 121 do not move away from their positions due to external shocks.

If printing is performed again when the nozzle 108 is capped (FIG. 7E), the control unit rotates the feed roller shaft 101 to rotate the maintenance gear 150 again in the arrow B direction by 90° (S20, S21). Then, the protrusions 145*a* of the capping cam and the protrusions 143*a* of the wiper cam are positioned to be parallel with the bottom surface, and the cap guiding portion 122 descends within the lower end of the second guiding hole 134 by a force of the second return spring 126. When the cap guiding portion 122 descends, the cap 121 is separated from the nozzle 108, and therefore the carriage 105 can freely move to the right (arrow C) and print (S22). At this time, the wiper guiding portion 112 is also positioned in the lower end of the first guiding hole 132, and thus the wiper 111 does not interfere with the nozzle 108.

According to the maintenance apparatus used with an inkjet printer according to the present invention described above, the nozzle can be maintained by operating the wiper unit 110 and the capping unit 120 without a separate motor. However, in the case of the present invention, the connection gear 160 should always be positioned above the cut off portion 151 of the maintenance gear 150 at an initial stage before the inkjet printer starts printing. For this, it is necessary to go through with an initializing process to position the connection gear 160 on the cut off portion 151 when the printer is turned on.

When the printer is turned off, there are two positions at which the connection gear 160 and the maintenance gear 150 can be. One is that the printer is properly turned off and the carriage 105 is at the home position whereby the connection gear 160 is at the original position, i.e., at the partial gear portion 150*b*, (FIG. 7A) and the other is that the printer is improperly turned off and the carriage 105 is at the maintenance position and the connection gear 160 is pushed to the left, whereby the connection gear 160 is at the whole gear portion 150*a*. However, in order for the carriage 105 to perform a printing process, the cap 121 and the wiper 111, which are in the carriage 105 moving direction A, should be in the descended position. In the position where the printer is properly turned off, if the feed roller shaft 101 is rotated to rotate the maintenance gear 150 by 360°, the maintenance gear 150 rotates and then stops when the cut off portion 151 is below the connection gear 160, and therefore the cap 121 and the wiper 111 are in the descended position. In a case that the printer is improperly turned off, if the connection gear 160 is returned to the original position and then rotated by 360°, the cap 121 and the wiper 111 are in the descended position, as in the state in which the printer is properly turned off.

Therefore, the initializing process for satisfying both cases is that the feed roller shaft 101 is rotated to rotate the maintenance gear 150 by 360° and then the carriage 105 is moved as much as the distance between the maintenance position and the home position. After that, the feed roller shaft 101 is rotated to rotate the maintenance gear 150 again by 360°. Then, regardless of where the carriage 105 stopped with respect to the ending of the printing, the carriage 105 can be moved to the printing area without being interfered with by the cap 121 or the wiper 111.

As described above, with the maintenance apparatus used with an inkjet printer according to the present invention, without having to use a separate motor, nozzles of a print head can be maintained in desired condition through maintenance operations such as nozzle cleaning and nozzle covering.

Further, because the cap and the carriage are fastened to each other during the capping, the cap can be maintained at a predetermined position with respect to the nozzles.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A maintenance apparatus used with an inkjet printer which conveys paper to a feed roller and prints by spraying ink through a nozzle of a print head loaded on a carriage, the maintenance apparatus to maintain the nozzle of the print head comprising:

a maintenance member moves to clean and cover the nozzle of the print head;

a maintenance cam to control the maintenance member through a rotating motion; and a connection unit to selectively transmit a power of the feed roller to the maintenance cam through the carriage, wherein, in accordance with the movement of the connection unit by the carriage, the maintenance cam is rotated by the power from the feed roller so that the maintenance member cleans and covers the nozzle of the print head.

2. The maintenance apparatus used with the inkjet printer according to claim 1, wherein the connection unit comprises:

a connection gear being disposed on a shaft of the feed roller and movable in a shaft direction by the carriage to transmit power of the feed roller; and a maintenance gear disposed at one end of the maintenance cam and engaging the connection gear by the connection gear moving in the shaft direction.

3. The maintenance apparatus used with the inkjet printer according to claim 2, wherein the maintenance gear has a cut off portion formed thereon in which a part of gear teeth is partially cut off in a face width direction, the connection gear is positioned on the cut off portion, and the power of the feed roller is not transmitted to the maintenance gear during a printing process.

4. The maintenance apparatus used with the inkjet printer according to claim 3, wherein the connection gear is supported in the shaft direction of the feed roller by a return spring, and the return spring returns the connection gear to place the connection gear on the cut off portion of the maintenance gear when the connection gear is not forced by the carriage.

5. The maintenance apparatus used with the inkjet printer according to claim 3, wherein the connection gear comprises a lever contacting the carriage.

6. The maintenance apparatus used with the inkjet printer according to claim 5, wherein the lever comprises a lever shaft to support the connection gear to move in the shaft direction of the feed roller.

7. The maintenance apparatus used with the inkjet printer according to claim 2, wherein the maintenance member comprises:

a wiper unit to allow the carriage to clean the nozzle;

a capping unit to cover the nozzle; and a frame to guide the wiper unit and the capping unit to be elevated by the maintenance cam.

8. The maintenance apparatus used with the inkjet printer according to claim 7, wherein the wiper unit comprises:

a wiper to clean the nozzle;

a wiper guiding portion to support the wiper and being elevated with respect to the frame by the maintenance cam; and a first return spring to bias the wiper guiding portion downwards.

9. The maintenance apparatus used with the inkjet printer according to claim 7, wherein the capping unit comprises:

a cap to cover the nozzle;

a cap elastic member to elastically bias the cap upward;

a cap guiding portion with the cap elastic member disposed thereon, the cap guiding portion being elevated with respect to the frame by the maintenance cam; and a second return spring biasing the cap guiding portion downward.

10. The maintenance apparatus used with the inkjet printer according to claim 9, wherein the cap guiding portion further comprises a fixing support inserted in the carriage when the cap covers the nozzle.

11. The maintenance apparatus used with the inkjet printer according to claim 7, wherein the maintenance cam comprises:

a wiper cam to elevate the wiper unit; and a capping cam positioned at a predetermined angle with respect to the wiper cam when viewed from the shaft direction, the capping cam elevating the capping unit.

12. The maintenance apparatus used with the inkjet printer according to claim 11, wherein the maintenance cam is fixed by a fixing member when the connection gear is not engaged with the maintenance gear.

13. The maintenance apparatus used with the inkjet printer according to claim 12, wherein the fixing member comprises:

a fixing cam groove formed on the maintenance cam; and a fixing portion disposed on the frame and inserted in the fixing cam groove to prevent the maintenance cam from rotating when the connection gear is not engaged with the maintenance gear.

14. The maintenance apparatus used with the inkjet printer according to claim 7, wherein the angle of the capping camp with respect to the wiper cam is 180°.

15. The maintenance apparatus of claim 1, wherein the connecting unit receives the power of the feed roller, and transmits the received power of the feed roller to the maintenance cam according to a movement of the carriage.

16. The maintenance apparatus of claim 1, wherein the connecting unit moves in a same direction as a movement of the carriage to transmit the received power of the feed roller to the maintenance cam.

17. The maintenance apparatus of claim 1, wherein the connecting unit rotates with respect to the feed roller.

18. The maintenance apparatus of claim 1, wherein the connecting unit rotates together with the feed roller.

19. The maintenance apparatus of claim 1, wherein the connecting unit moves along a movement direction of the carriage and rotates about the feed roller to transmit the power of the feed roller to the maintenance cam.

20. An inkjet printer which conveys paper to a feed roller, prints by spraying ink through a nozzle of a print head loaded on a carriage, and performs maintenance of the nozzle of a print head comprising:

a maintenance member moving to clean and cover the nozzle of the print head;

a maintenance cam to control the maintenance member through a rotating movement;

a maintenance gear disposed at one end of the maintenance cam and having a cut off portion with a part of gear teeth partially cut off in a face width direction; and a connection gear disposed on a shaft of the feed roller to transmit power of the feed roller and move in a shaft direction at the same time, wherein the connection gear is positioned on the cut off portion of the maintenance gear while the carriage prints, and is engaged with teeth of the maintenance gear at one side of the cut off portion when the carriage pushes the connection gear, thereby rotating the maintenance cam.

21. The inkjet printer according to claim 20, wherein the connection gear is supported in the shaft direction of the feed roller by a return spring, and the return spring returns the connection gear to place the connection gear on the cut off portion of the maintenance gear when the connection gear is not forced by the carriage.

22. The inkjet printer according to 21, wherein the maintenance member comprises:

a wiper unit to allow the carriage to clean the nozzle;

a capping unit to cover the nozzle; and a frame to guide the wiper unit and the capping unit to be elevated by the maintenance cam.

23. The inkjet printer according to claim 22, wherein the wiper unit comprises:

a wiper to clean the nozzle;

a wiper guiding portion to support the wiper and being elevated with respect to the frame by the maintenance cam; and a first return spring to bias the wiper guiding portion downward.

24. The inkjet printer according to claim 22, wherein the capping unit comprises:

a cap to cover the nozzle;

a cap elastic member to elastically bias the cap upward;

a cap guiding portion with the cap elastic member disposed thereon, the cap guiding portion being elevated with respect to the frame by the maintenance cam; and a second return spring to bias the cap guiding portion downward.

25. The inkjet printer according to claim 24, wherein the cap guiding portion further comprises a fixing support inserted in the carriage when the cap covers the nozzle.

26. The inkjet printer according to claim 22, wherein the maintenance cam comprises:

a wiper cam positioned at a predetermined angle with respect to the cut off portion of the maintenance gear and elevating the wiper unit; and a capping cam positioned at a predetermined angle with respect to the wiper cam, and elevating the capping unit.

27. The inkjet printer according to claim 26, wherein the predetermined angle of the capping cam with respect to the wiper cam is 180°.

28. The inkjet printer according to claim 26, wherein the maintenance cam is fixed by a fixing member when the connection gear is on the cut off portion of the maintenance gear.

29. The inkjet printer according to claim 28, wherein the fixing member comprises:

a fixing cam groove formed on the maintenance cam; and a fixing portion disposed on the frame and inserted in the fixing cam groove to prevent the maintenance cam from rotating when the connection gear is on the cut off portion of the maintenance gear.

30. A maintenance apparatus usable in an inkjet printer having a carriage, a rotating member, and a nozzle of a print head provided on the carriage, the maintenance apparatus comprising:

a maintenance unit to perform at least one of cleaning, storing, and covering the nozzle of the print head by moving a maintenance tool to the nozzle;

a maintenance cam to control movement of the maintenance unit through a rotating motion of the rotating member; and a connection unit to receive a power of the rotating roller to selectively transmit a power of the rotating member to the maintenance cam according to a movement of the carriage.

* * * * *